United States Patent [19]

King et al.

[11] 4,168,013

[45] Sep. 18, 1979

[54] HIGH TEMPERATURE INSULATING CONTAINER

[75] Inventors: William C. King; Thomas Reed, both of Chelsea, Mass.

[73] Assignee: Trans Temp Inc., Chelsea, Mass.

[21] Appl. No.: 842,557

[22] Filed: Oct. 17, 1977

[51] Int. Cl.[2] ..... B65D 25/18

[52] U.S. Cl. ..... 220/414; 220/426; 220/442; 220/445; 220/450; 266/257; 266/264

[58] Field of Search ..... 249/204; 266/256, 263, 266/264, 257; 432/226, 250, 19, 21, 23; 126/273.5; 220/9 LG, 9 D, 9 C, 420, 421, 423, 426, 442, 414, 450, 445, 440

[56] References Cited

U.S. PATENT DOCUMENTS

| | | | |
|---|---|---|---|
| 662,217 | 11/1900 | Brady | 220/9 LG |
| 673,073 | 4/1901 | Bobrick | 220/9 LG |
| 1,120,877 | 12/1914 | Wright | 126/273.5 |
| 1,306,281 | 6/1919 | Round | 220/9 R |
| 1,892,112 | 12/1932 | Moore et al. | 266/264 X |
| 1,956,323 | 4/1934 | Gregg | 220/9 D |
| 1,964,795 | 7/1934 | Frary | 220/9 D |
| 1,968,088 | 7/1934 | Mekler | 220/442 X |
| 2,020,184 | 11/1935 | Hodson et al. | 266/263 |
| 2,119,438 | 5/1938 | O'Leary | 220/15 |
| 2,187,594 | 1/1940 | Wean | 266/257 X |
| 2,195,077 | 3/1940 | Brown | 220/422 X |
| 2,303,901 | 12/1942 | Baker | 266/256 |
| 2,791,418 | 5/1957 | Edelmann | 266/263 |
| 2,999,366 | 9/1961 | La Fave et al. | 220/9 LG |
| 3,009,601 | 11/1961 | Matsch | 220/9 LG |
| 3,114,469 | 12/1963 | Francis et al. | 220/9 D |
| 3,354,021 | 11/1967 | Royet | 220/9 D |
| 3,510,363 | 5/1970 | Winkler et al. | 220/9 D |

FOREIGN PATENT DOCUMENTS

| | | | |
|---|---|---|---|
| 477341 | 10/1915 | France | 126/273.5 |

*Primary Examiner*—William Price
*Assistant Examiner*—Allan N. Shoap
*Attorney, Agent, or Firm*—Jerry Cohen

[57] ABSTRACT

Mill processing of ingots and like metal articles at or after bringing to temperatures above about 900° C. is enhanced through self-heat soaking at such high temperatures to homogenize temperature and structural parameters throughout the body of such article. In particular this improves workability of such article for forging or rolling. The insulation comprises thin metal foils or the like separated by alternating layers of subdivided fibrous insulation, preferably in felted, woven or other sheet form and structured to maintain structural integrity at such high temperatures, and provides insulation of the metal article surrounded by such insulation and reduces scale formation and eliminates the need for flame or other external heat source or the need for heavy and/or voluminous handling and furnace equipment.

2 Claims, 5 Drawing Figures

HIGH TEMPERATURE INSULATING CONTAINER

BACKGROUND OF THE INVENTION

The present invention relates to high temperature insulating, particularly in connection with providing a metallurgical soaking to a cooling ingot of steel to slow down the rate of cooling, enabling self-heat induced thermal structural homogenization within the ingot so that upon subsequent mill processing (rolling, swaging, forging or the like), equipment breakage is thereby minimized. This is accomplished through the present invention through structure affording the additional advantage of avoiding the high volume and energy usage of conventional soaking pits used for such purposes.

The insulating apparatus is usable for furnaces generally operating in a similar range of temperatures.

During steel production, molten steel (at about 1500° C.) is poured into iron molds and allowed to freeze on the outside surfaces. The mold is then stripped away and cooling is continued until the ingot is frozen. In order to permit hot rolling, the ingot is then put in a soaking pit which has burners therein (usually oil fired) and resides in such pit for half a day, exposed to flame or to air heated by the flame to come back up to appropriate temperature for rolling, in the range of 1000–1400° C. The soaking pit structure is quite bulky and one or more ingots "soaked" therein generally occupy a small portion of the space. But the entire space has to be heated up and the energy consumption involved is substantial. The handling equipment associated with the soaking pit is also voluminous and expensive.

It is an important object of this invention to eliminate the energy consumption associated with such soaking process.

It is a further object of the invention to reduce the volume, mass and expense of the soaking equipment and associated handling equipment and process steps.

It is a further object of the invention to reduce scaling of soaked metals.

It is a further object of the invention to reduce initial freezing rate of the ingot with resultant improvement of ingot grain structure.

It is a further object of the invention to provide insulating method and apparatus which enables self-heat induced soaking of a poured ingot.

It is a further object of the invention to provide insulation apparatus and process usable broadly in connection with 900° C. or above applications.

It is a further object of the invention to provide practical and effective high temperature insulation.

The foregoing objects also include the further ancillary object of achieving each such objects in combination with one or more of the others.

SUMMARY OF THE INVENTION

In accordance with the present invention, an ingot or like article of metal is processed during its initial resolidification cooldown, with or without stripping the iron mold therefrom. The ingot (or the like) is placed on a stool or other support and surrounded by a chamber-defining insulation which has walls surrounding the ingot, but spaced therefrom and a ceiling above the ingot but spaced therefrom.

The wall and ceiling structures each comprise an inner wall member spaced from an outer wall member and, therebetween, alternating layers of thin metal foil or the like (e.g., graphite) and fibrous sheets made up of ceramic fibers in a felted or woven form with fibers running generally parallel to the long dimensions (length and/or width) of the sheet. The inner wall is preferably corrugated or otherwise constructed to allow for and compensate thermal expansion without distorting the assemblage.

Preferably there are 5–50 foil layers interspersed with 5–50 fibrous layers. But there may be as many as 50–100 each of the foil and fibrous layers. The subdivision of ceramic fibrous insulation into this layered form by the intervening foil layers prevents compaction which would occur to such fibrous insulation used without such subdivision and intervening metal foil. In turn, the fibrous ceramic layers act as spacers for the metal foil and it is important to have these synergistic effects of the foils and the fibers (or equivalent spacers) upon each other, together with the layout of the fibers parallel to the foils' long dimensions, as opposed to extending transversely wherein any fibers would act as heat conductors. The foils and intervening fibrous layers may be arranged concentrically or as a double spiral or in other combinations.

Preferably a single side wall assemblage of circular or elliptical form is provided. But flat partial wall segments may be used in octagonal, rectangular or other arrangements, with special provision made at corners to form a chamber through a combination arrangement of such wall segments. In any such arrangement, the side wall (or walls) assemblages define an unroofed chamber and a similar insulating assemblage is provided as a ceiling overlying the space defined by the side wall assemblage(s) and also overlying the side wall assemblage(s) per se. The ceiling assemblage also has preferably 5–50 metal foil or the like interspersed with 5–50 ceramic fiber layers or the like. An inner ceiling structural layer is provided. However, an outer ceiling structural layer is sufficiently spaced from foil/fibrous layer assemblage to allow for an air expansion space and a check valve is placed in the air expansion space to allow for relieving the pressure built up as air in the insulation as heated up by exposure to the cooling ingot. Relief holes are provided throughout the insulation structure to avoid trapped gas pockets therein. Gettering material may be provided in the expansion space or elsewhere in the insulating apparatus to getter oxygen and limit the degree of scaling which will occur on the surface of the heat shields.

Other objects, features and advantages of the invention will be apparent from the following detailed description of preferred embodiments thereof, taken in connection with the accompanying drawing in which,

DETAILED DESCRIPTION OF PREFERRED EMBODIMENTS

Figure 1:
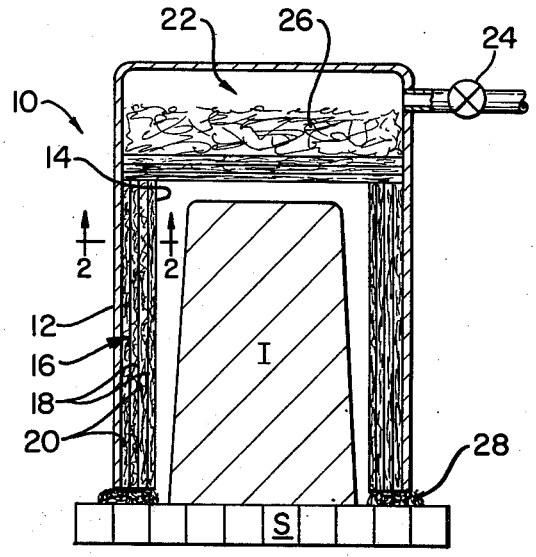
FIG. 1 is a cross section view of an insulated ingot in accordance with a first preferred embodiment of the invention, and, FIG. 2 is a section of a detail portion, taken orthogonal to the viewing direction of FIG. 1 as indicated at 2–2 in FIG. 1, and FIGS. 3, 4 and 4A show parts of variant embodiments from FIGS. 1–2.

The insulation apparatus comprises an outer structural wall 12 which is circular and has a ceiling and an inner structural wall 14 which is similarly circular and has a ceiling. An insulation space 16 is defined between the structural walls 12 and 14 and alternating insulation layers 18 and 20 of metal foil and ceramic fiber, respectively, are placed therein. The wall 12 has greatest thickness for high structural integrity, but need not have high temperature capabilities since it will not see temperatures above 500° F. The inner wall 14 is preferably corrugated or given other provision to prevent buckling in the course of extreme temperature cycles it will encounter. It is thicker than the reflective foil and made from an oxidation resistant metal such as Inconel or like high temperature metal.

An expansion space 22 is provided in the upper portion of the apparatus and a bed of gettering material 26 is provided therein. A two way check valve 24 allows relief of overpressure in space 22 resulting from overpressure anywhere in the insulation apparatus as a whole to be relieved and allows underpressure to be relieved by drawing in air from the outside. A ceramic fiber seal 28 prevents air from excaping or being drawn in at the bottom of the insulation.

A cooling, but still hot—above metallurgically hot temperature of 900° C.—ingot I is placed on a stool S and an insulation apparatus 10 is placed over the ingot.

In addition to protecting the ingot from scaling, the limitation of oxidation by gettering material 26 and seal 28 protects the metal foil from oxidation. The unoxidized metal foil generally has a much better emisitivity (lower) for purposes of insulation than it would have if significant oxidation were allowed. The gettering material may comprise graphite fibers or charcoal.

Preferably, fibers such as aluminum silicates (mullite) or graphite fiber are used in the fibrous layers. These are available in paper-like forms, e.g., Carborundum Company's Fibrefax. The foils are 0.001 to 0.005 inches thick reflective metal such as stainless steel, Inconel or nickel which maintain good reflective properties and adequate strength at high temperatures.

EXAMPLE 1

An 11"×14"×22" (height) steel ingot was cast in a mold set on a stool, the mold removed and shortly after removal (about a minute) a device as described above—having 10 foils and 14 fiber layers in a jellyroll spool—was applied over the ingot and remained in place for 22 minutes and was then removed. Afterwards the ingot was hot rolled without soaking or other application successfully contrary to the experience (without insulation) based expectations of the rolling mill operators. Rolling forces needed were heigher, but acceptably so compared to those usually required for hot rolling (after heating up to 1350° C. in a soaking pit). It was also surprising to observe that there was virtually no scale formation after removal of the device, contrary to experience with cooling an uninsulated ingot, wherein heavy scale is formed.

EXAMPLE 2

A simulated ingot heat source was established—a 9 ohm spiral Inconel resistance wire with external cladding 10½ inches long surrounded by various insulation devices based on the above description. It was supplied with a controllable power source. The criteria of test was the wattage necessary to reach a given temperature. Time to reach 1000° C. (or other highese temperature reached after 10 minutes of constant power of 1000 watts) was measured. The results are shown in Table I (next page) for various insulations. The experimental apparatus had end shielding to minimize end effect heat losses.

The results show best insulation value for ceramic fibers done on a simple carbon or silica block but with a thickness of 65 mm (#8, #10 and #11) compared to good insulation values for insulation of the Example 1 embodiment or the like (#6, #7 and #9) at 20–30 mm thickness. Run #5 shows thickness saving prospects for multiple heat shields alone without intervening ceramic fibers or the like [compared to #1 and #2].

The low thickness and low mass of the present invention afford short times for the insulation to stabilize, an important consideration for use in retarding the rate of ingot cooling.

| Various Insulating Materials | I.D. & O.D. | Power to Reach 1000° C. in watts | Time to reach 1000° C. or highest temperature reached after 10 minutes on constant power of 1000 watts |
|---|---|---|---|
| 1. No Insulation | | 15,000 watts (calculated figure) | 368° C. |
| 2. Two heat shields of polished aluminum foil (alzac) | 77–80 mm | 678 (calculated figure) | would melt |
| 3. Gold mirror | 106–110 mm | 672 | 11 min. 40 sec. |
| 4. Silver mirror | 77–80 mm | 959 | 14 min |
| 5. 5½ stainless steel heat shields | 60–75 mm | 1430 | 887° C. |
| 6. 5½ stainless steel heat shields lined with ⅛ th" ceramic material | 60–80 mm | 480 | 8 min |
| 7. Twelve stainless steel heat shields lined with ⅛ th" ceramic material | 64–94 mm | 333 | 7 min 15 sec |
| 8. Ceramic material without stainless steel heat shields | 65–130 | 341 | 9 min 20 sec |
| 9. 12 stainless steel heat shields lined with graphite | 65–130 | 499 | 8 min 44 sec |
| 10. Amorphous Silica | 60–125 | 324 | 9 min 55 sec |
| 11. Carbon Thermal Block | 65–130 | 230 | 13 min 32 sec |

The rolling experience described above in Example 1 demonstrates the importance of the process of the invention and of the equipment used. Usually corners of cooled ingots and other distinct areas are harder than other parts and disrupt later fabrication unless thoroughly homogenized by soaking over many hours. The self heat homogenization of the ingot by insulated slow cooling in accordance with FIGS. 1-2 embodiment resolves the problem in a way meeting all the above stated objects of the invention.

Figure 2:
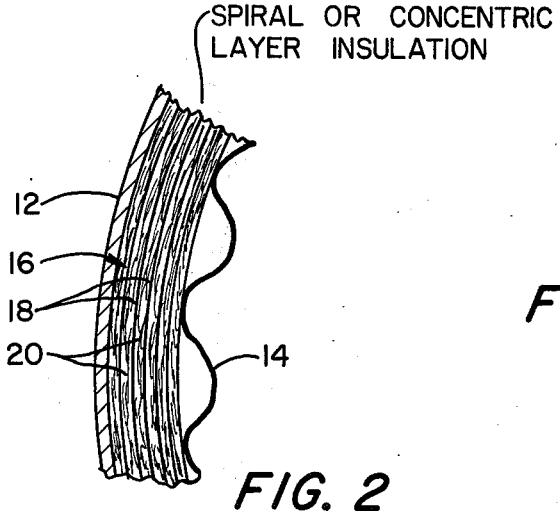

The above described structure of FIGS. 1-2 and the like can also be used for insulation or furnace shielding in air or inert gas furnaces.

Figure 3:
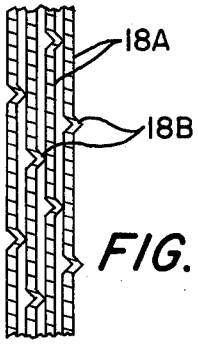
Figure 4:
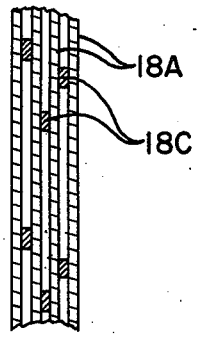
Figure 4A:
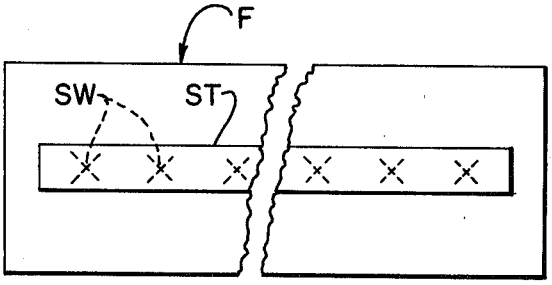

In other embodiments of the invention usable in selected applications, some or all of the fibrous ceramic layers may be replaced by otherwise particulated ceramics such as powders. Fibers or powders may be lightly sintered or held together by temporary or permanent binders or through sponge-like ceramics may be provided; in any case, density should be less than 50% theoretical for the ceramic. Air gaps alone may be used between foils instead of ceramics with spacing provided by other means such as by spaced (and staggered from foil to foil 18A) indentations or dimples 18B in FIG. 3 or by spaced (and staggered from foil to foil 18A) welded on tabs 18C in FIG. 4. FIG. 4A shows a single foil F with a metal strap ST welded on at points SW. When the foil is rolled into a spiral, the strap will buckle between welds to provide spacing between turns of the spiral.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. An insulating container for placement over a hot metal ingot or like article to lower heat loss, equilibrate article temperature and prevent scaling, and comprising:

spaced apart inner and outer side walls, said container having top walls that are spaced apart, the spacing between said top walls and said side walls having insulation therein, said insulation comprising layers of thin, reflective radiation foil shields spaced apart by fibrous ceramic layers, the outer side wall being higher than the inner side wall, the spacing between said top walls being substantially greater than the spacing between said side walls, the outermost top wall being spaced above said insulation in the spacing between said top walls to define an expansion space, getter means located in said expansion space for absorbing oxygen, the interior of said container for said article defined by said inner side wall and the innermost top wall, the bottom of said inner side wall being opened for placement of said container over said article, seal means located at the bottom of the container and surrounding the opening, said seal means extending between the bottom edges of said inner and outer side walls and thereby limiting air into said container to prevent oxidizing of said shields, check valve means in said container providing communication between said expansion spaced and the exterior thereof to regulate pressure.

2. The insulating container of claim 1 wherein the alternating foil shields and fibrous ceramic layers between said side walls are spiralled at least in part.

* * * * *